United States Patent [19]

Thiel et al.

[11] 4,006,839

[45] Feb. 8, 1977

[54] CONTAINER WITH SNAP COVER HAVING FRANGIBLE PORTIONS

[75] Inventors: Alfons W. Thiel, Mainz; Hans Hell, Wiesbaden-Freudenberg, both of Germany

[73] Assignee: Bellaplast GmbH, Wiesbaden-Biebrich, Germany

[22] Filed: Mar. 10, 1976

[21] Appl. No.: 665,409

[30] Foreign Application Priority Data

July 28, 1975 Germany ..... 2533631

[52] U.S. Cl. ..... 220/266; 220/306; 220/307; 220/359; 229/43

[51] Int. Cl.[2] ..... B65D 41/32

[58] Field of Search ..... 220/214, 266, 306, 307, 220/359; 229/43, 51 TC; 215/250, 253; 150/.5

[56] References Cited

UNITED STATES PATENTS

| | | | |
|---|---|---|---|
| 3,276,616 | 10/1966 | Lurie | 220/359 X |
| 3,613,940 | 10/1971 | Davis | 220/307 |
| 3,773,207 | 11/1973 | Dokoupil et al. | 220/266 X |

*Primary Examiner*—George T. Hall

*Attorney, Agent, or Firm*—Strauch, Nolan, Neale, Nies & Kurz

[57] ABSTRACT

A container assembly wherein an initially filled container and its closure cover have coextensive flat edge regions attached by welds and also have independent snap fit connection. To safeguard against unauthorized opening and reclosing, provision is made for producing a tear line pattern in the cover upon detaching the edge regions at the welds, such rendering the edge regions incapable of undetectable reassembly to initial cover closed condition, but not affecting the ability of the snap fit connection to more or less temporarily reclose the assembly.

24 Claims, 29 Drawing Figures

CONTAINER WITH SNAP COVER HAVING FRANGIBLE PORTIONS

This invention concerns containers with snap covers, the containers being shaped with an annular flat area on their opening edge which holds the snap cover, while the snap cover manifests an essentially flat, annular area along its periphery lying over the flat edge area of the container separately from its snap device which grips into or over a part of the container. Containers of this type are extensively used as bowl-shaped or can-shaped packing containers for milk products, margarine and the like. These packing containers can be round, rectangular, oval, tall or shallow.

Containers of this type are also known in very flat configuration, as plates for prepared food. In this case, the containers are characterized by a very wide opening, which can be closed by a flat snap cover. With containers of this type, it is difficult to safeguard the cover against unauthorized, partial or complete opening after the filling of the container and subsequent closure. This invention applies particularly to thin-walled containers composed of thermoplastic synthetic material, where, on the one hand, the application of a seal or other safeguarding components is not possible because of the small wall thickness and, on the other hand, would be too costly for such mass-produced articles.

Containers are also known, particularly synthetic plastic containers for packing milk products and the like, where a foil cover, for example of synthetic material or synthetic-metal laminate, is placed over the opening and sealed to the edge of the opening. For the purpose of opening these filled and sealed containers, the cover foil must be torn off, which precludes the reuse of the cover for the closure of the container however. Therefore, these containers can normally be used only for those applications where the content of the container is immediately used all at once.

It is an object of this invention, for a container with a snap cover that can be applied and removed several times, to provide a safeguard of originality for the contents of the container, characterized in that this safeguard tears in the first opening of the container, or even upon partial lifting of the cover, and leaves a clearly visible tear pattern, whereby even though the cover, with its snap device, remains applicable, effectively, to return to a secure closure position on the container.

This problem is solved in such a manner that, in the case of a filled, originally closed container, the flat, annular edge area of the cover may be fastened in spots to the flat area of the container edge and a nominal tear line having at least sectional irregular configuration is associated with each fastening point, the snap device and its connection with the cover being maintained against destruction.

This invention ensures that, due to the considerable resistance which fastening of the cover on the edge of the container generates against a removal of the cover, it is brought to the attention of a customer that this is an originally packed product and the package should not be opened thoughtlessly. If, however, the cover is lifted only a little, or completely removed, with the application of the required increased force, the nominal tear line pattern appears over a distance and results in an irregular tear in the cover which makes it possible to reassociate the two parts which were torn from each other. A conspicuous mark is thus created, making it immediately obvious whether a package had already been opened, even partly. On the other hand, the snap formation of the cover and the cooperating formation of the container are not deleteriously affected by the partial and even by complete tear. Therefore, the snap cover can be repeatedly replaced onto the container if, for example, the content of the container should be used by repeated removal of portions of the content. The assurance of originality which is provided by this invention can be applied to the closed container simply, easily, and inexpensively.

One possibility for the assurance of originality in accordance with this invention consists of forming the fastening point as a non-detachable weld between the edge of the cover and the edge of the container, whereby the nominal tear line effectively surrounds this weld. For example, such a weld can be configured as a small area weld of the desired geometric configuration, for example in the form of a point, a line, or the like. However, it is also possible to provide a small line weld with completely or alsmost completely closed desired geometric configuration, for example as a triangle, ring, oval, or the like. In each case, the nominal tear line can be preformed by thinning the material or by cuts in the edge of the cover which are arranged around the weld. It is also possible to preform the nominal tear line through the configuration of the edge of the weld itself. In the case of this type of fastening points with non-detachable, relatively small welds, a plurality of small weld points are preferably distributed around the circumference of the edge of the cover and the edge of the container. In that case, in the attempt to lift off the cover, at least one of these small weld points will tear and form the desired tear mark.

Another possibility of protecting the circumference of the cover against unauthorized lifting from the edge of the container consists of arranging one or more welds in an area of the edge of the cover which is preformed for gripping and removal of the cover from the container, while the remaining area of the circumference of the edge of the cover is secured against gripping and removal. Thus, for example, the edge of the cover can be surrounded by a protruding collar of the container edge and provided with one or more gripping tongues, and at least one weld point is arranged in the area of each gripping tongue. It is also possible to provide the edge of the cover with one or several gripping tongues, with at least one weld point each, and otherwise with its flat edge area, to detachably weld it or seal it to the flat edge area of the container edge. In this manner, it is assured that the possibility for the gripping and the removal of the container exists only in the area of the gripping tongues, while the remaining areas of the circumference are normally held fast on the edge of the container.

In accordance with another embodiment of this invention, the flat, annular edge area of the cover is fastened to the flat area of the container edge by means of a strip or line annular weld which extends around the periphery and, along this fastening a perforation arrangement is provided in the edge of the cover as the nominal tear line. In this embodiment of the invention, it is accomplished that, in the loosening of these fastenings, or in tearing the cover from these fastening points, the perforation is torn open without fail at least over a distance, the irregularly protruding tear line portions ensure that the cover edge cannot again be applied in its original position.

A particular possibility of an embodiment of this type consists of letting the snap device of the cover engage an undercut on the inner periphery of the container, while the annular weld is arranged on the outer periphery of the cover edge and the container edge and the perforated region is arranged between the annular weld and the snap device of the cover. In the case of this embodiment, the cover can be provided, along its outer periphery, with at least one, for example tongue-shaped, grip portion and the annular weld can be detachable and serve as a seal. It may be assumed that a solution of the initially described technical problem would not be possible in this manner. However, it has been shown in fact that, in the loosening of the outer annular edge portion which is detachably welded or sealed to the edge of the container, the snap device of the cover, which reaches into the container opening, is totally adequate to hold the remaining portion of the edge of the cover in contact with the container edge and allow the perforation to tear open.

Another possibility of an embodiment of the second type consists of providing the cover, on its outer periphery, with at least one, for example tongue-shaped grip, portion and to let the perforated region cross the annular weld on both sides of the grip portion and end in the periphery of the cover. In pulling the cover loose from the edge of the container, the weld points disposed between the grip portion and the container edge itself are first either loosened, or ton out of the cover material, and, at the same time the ends of the perforated region are torn open. At least in the perforated region, a change in the nominal tear line then results, which can no longer be brought back into the original condition. For complete opening of the cover, it is torn out along the perforated region from an annular portion which remains on the edge of the container, and can subsequently be removed from the container edge if desired.

Finally, a configuration can be effected in the above described second embodiment where the cover is provided, on the inner periphery of its snap device, with at least one grip portion which is configured in the shape of an enlarged undercut. If the cover is seized on this grip portion and pulled from the container edge, then the perforated region which is applied here also tears.

In these possible embodiments, the annular weld can be formed by a series of detachable point or line weld, also serving as sealing points. In this case, the perforated region is a series of longitudinal cuts, which may not be oriented with respect to each other, and this thus may cause an irregular configuration of the tear line.

Within the scope of this invention, the flat area of the container edge can be made in a conspicuous color contrast to the flat, annular edge area of the cover. This has the advantage that a change in the nominal tear line also becomes especially well-marked and conspicuous by the visible color difference. The invention if preferably useful for those containers in which at least the flat, annular edge area of the cover consists of thermoplastic synthetic material. The invention also finds application when both the container itself and the cover are of thermoplastic synthetic material. Within the scope of this invention, the edge of the container should have a considerably greater tear resistance than the edge of the cover, either because of heavier wall thickness or because of stronger material.

PREFERRED EMBODIMENT

Figure 1:
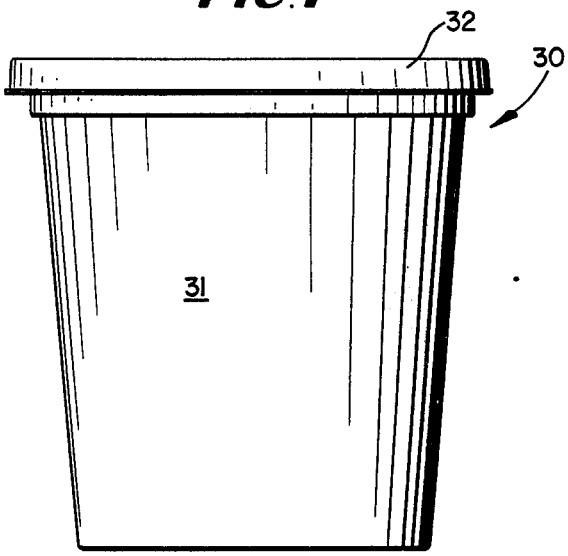
FIG. 1 is a side view of a bowl-shaped packing container in accord with an embodiment of the invention.

The embodiments illustrated in FIGS. 1 to 4 are bowl-shaped packing container units 30, for example for margarine or the like. This packing container manifests a container 31 and a snap cover 32. With an annular snap formation 34 (FIG. 3) which is disposed at the inner periphery of its edge portion 33, the snap cover extends into an annular undercut recess 36 formed at the inner periphery of the container edge 35. The container itself is configured with a circular top edge flange or rim which has, on its upper side, a flat annular area 37 which is essentially planar and perpendicular to the longitudinal axis of the container.

The edge of the cover 32 has a corresponding flat annular edge area 38 which in the assembly lies with its underside on flat area 37 of the container edge 35.

Figure 2:
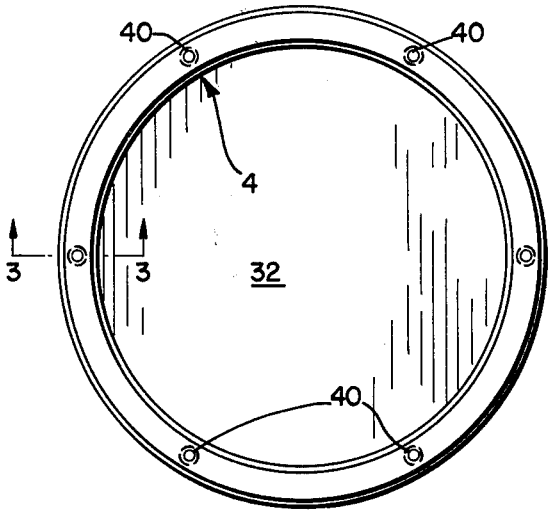
FIG. 2 is a plan view of the container in FIG. 1.
Figure 3:
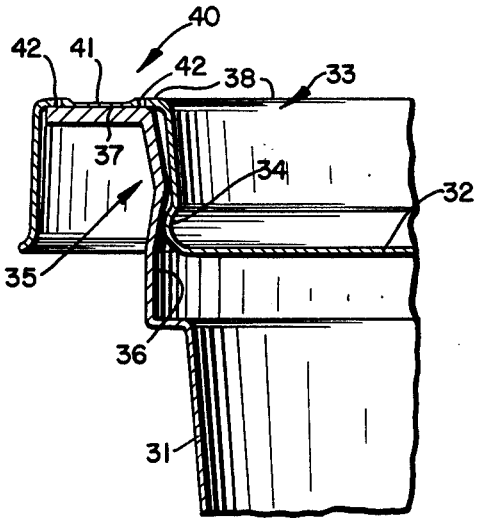
FIG. 3 is an enlarged section substantially along line 3—3 of FIG. 2.
Figure 4:
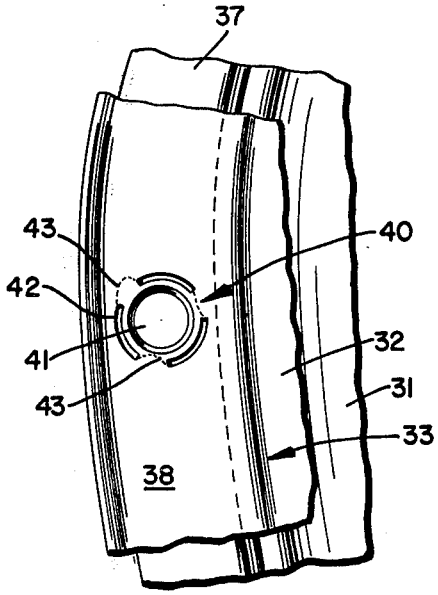
FIG. 4 is an enlarged fragmentary plan view of the area designated at 4 in FIG. 2.
Figure 5:
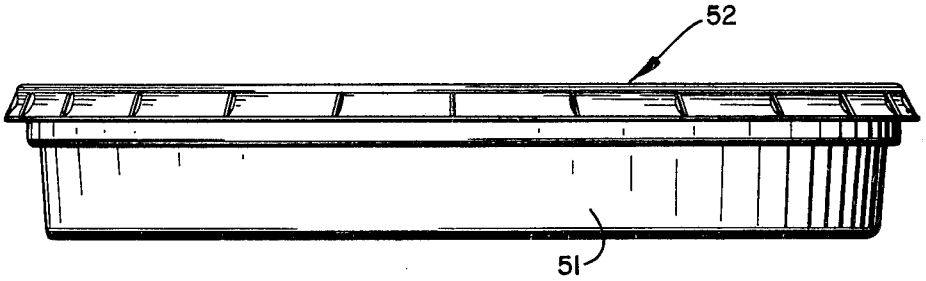
FIG. 5 shows a side view of a menu plate with snap cover as a container in accord with the invention.

As shown in FIGS. 2–4, a number of fastening points 40 are distributed over the circumference of the cover edge 33 and the underlying rim of the container. In FIGS. 1–4, these fastening points 40 are each formed of a point, non-detachable integral weld 41 and a preformed nominal tear line 42 in the form of intermittent or spaced perforated cuts through the cover which effectively surround the weld. A non-detachable weld forms a substantially integral connection.

If it is desired to remove the cover 32 from the container 31, or only to lift it slightly, in order to look into the interior of container 31, at least one of the fastening points 40 must be torn open, with a small piece of the cover still attached to the container edge. On the cover between the perforated cuts which form the nominal tear line 42, an irregular tear pattern will result, as indicated by 43 in FIG. 4. This irregular tear 43 makes it impossible to again non-detachably close a fastening point 40, once it has been torn open, exactly in such a manner that all parts of the tear lines 43 will exactly interfit and abut. In this manner, there then results a conspicous tear mark in the area of a fastening point 40 which has been torn open once. However, as especially shown in FIGS. 3 and 4, the effectiveness of the snap device 34 of the cover is not deleteriously affected by tearing open one or all fastening points 40. Even if the edge 33 of the cover, with its flat annular edge area 38, can no longer completely lie on the flat area 37 of the container edge 35, the snap device 34 still grips sufficiently deep into the undercut 36 of the container edge to assure a solid and tight seat in the reclosed position of cover 32.

Thus in this embodiment opening the cover tears holes in the cover, the outlines of these holes defining the tear line pattern. FIGS. 5–8 show a second embodiment, in which the container is a closed menu plate 51. These menu plates 51, which are closed with a snap cover 52, have their field of use as packing containers for prepared meals which are frozen and stored in the packed condition. Prior to consumption, these prepared meals are heated to the appropriate temperature in high-frequency or like ovens. Both during storage and in transportation, the menu plate 51 with the snap cover 52 should be securely closed. Even after heating and for the purpose of serving, it should be possible to snap cover 52 onto the plate 51. As can be seen especially in FIG. 7, the snap cover 52 is provided with an annular snap bead 54 on the outer periphery of its edge 53, which grips over a downwardly and outwardly projecting collar 56 on the outer edge of container edge 55. As in FIGS. 1–4 the edge of the container again has an annular flat area 37, which is essentially plane and perpendicular to the container axis while the cover 53 has an annular flat edge portion 38 overlying flat area 37 of the edge of the plate 55.

Figure 8:
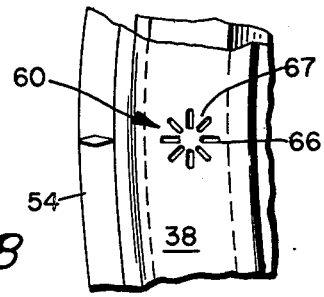
FIG. 8 is an enlarged fragmentary plan view of the area designated at 8 in FIG. 6.

In the example of FIGS. 5–8, the fastening points 60 are formed by essentially star-shaped welds 66, of which the edges themselves, as indicated by line 67 in FIG. 8, define an irregular nominal tear line. If thus the cover 52 should only be raised from the menu plate 51, at least one of the fastening points 60 must be torn open, resulting in a conspicuous, irreversible tear line pattern. On the other hand, the snap bead 54 of the cover 52 remains completely operable for reclosing the unit even if all fastening points 60 have been torn open and the cover 52 has been completely removed from the menu plate 51. Therefore, with its snap bead 54, the cover 52 can again be securely applied to the menu plate 51 after frequent removal.

Figure 9:
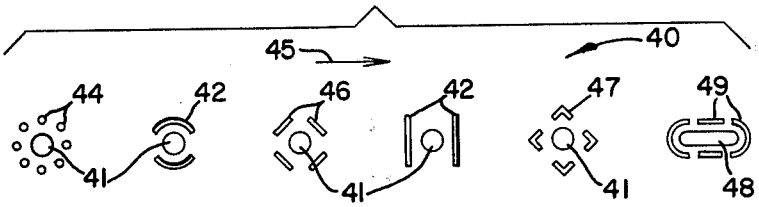
FIG. 9 illustrates a compilation of the configuration of weld points with associated nominal tear pattern or lines which are prepared by cuts.

FIG. 9 shows several structural examples of the fastening points 40 of FIGS. 1–4. Thus, a fastening point 40 can be formed in such a manner that a point-shaped non-detachable weld 41 is surrounded by a series of small perforations 44. However, as mentioned above, spaced cuts can also be used. In FIG. 4, for example, three narrow needlelike perforations are provided. FIG. 9 also shows two substantially semi-circular narrow perforations 42 which can extend either essentially in the direction of tear, which is indicated by the arrow 45, or across the direction of tear. A point-shaped non-detachable weld 41 can also be associated with a number of straight line perforations of which the number and position, with regard to the tear direction, can be selected as desired. As an example, FIG. 9 shows a fastening point 40 at which a point-shaped weld 41 is associated with four straight-line perforations 46, inclined to the direction of tear 45. Another possibility consists of applying cornered linear perforations 47 around a point-shaped weld 41. As shown in FIG. 9, the non-detachable weld points 48 may be elongated and surrounded by straight-line and curved perforations 49. In all instances the perforations substantially surround the nondetached weld point.

Figure 10:
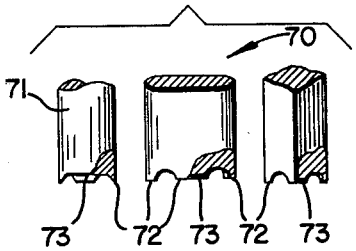
FIG. 10 shows schematic possibilities for the configuration of tools for the simultaneous preparation of welds with associated cut nominal tear lines in accord with FIG. 9.

The weld 41 (48) can be produced simultaneously with forming the associated perforations 42, 44, 46, 47 and 49 if, for example, tools 70 such as are shown in FIG. 10 are used. On the front of the tool die 71, these tools have cutters 72 and welding die faces 73. Thus, for example, the round die 71, illustrated on the left side of FIG. 10, is so configured that a fastening point 40 with point-shaped weld 41 and surrounding narrow perforations 42 can be produced in one operating step. In the same manner, for example, the welding die 71 illustrated centrally in FIG. 10, with an oval cross-section, is suitable for producing an elongated weld 48 with perforations 49 surrounding it. A welding die, shown at the right in FIG. 10 having a square cross-section, could be used, for example, for the preparation of a point-shaped weld 41 with angular perforations 47. In these cases, the welding dies in FIG. 10 may be in one piece with the cutting knives. Alternatively the cutting knives and dies may be separate elements arranged coaxially to each other and suitably guided.

Figure 11:
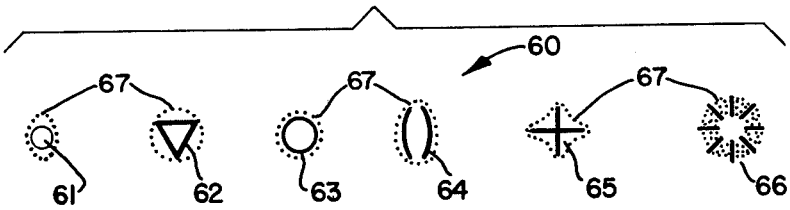
FIG. 11 illustrates a compilation of the configuration of welds, of which the edge portion itself forms the nominal tear line.

FIG. 11 illustrates several examples of rigid, i.e. non-detachable welds which establish the nominal tear line with their periphery at the same time. These welds can be areal in shape, such as, for example, the point-shaped weld area 61 shown in FIG. 11, or the form of a line, in order to form an open or closed geometric figure. As examples of line welds which form closed geometric figures, a triangular weld 62 and a circular weld 63 are shown in FIG. 11. In both cases, the flat cover portion disposed on the inside of the triangular or circular weld line will remain in the cover when a cover is torn off so that the nominal tear line is essentially defined by the outer periphery of the weld and the irregular pattern of the nominal tear line can be brought about by the irregular configuration of that outer periphery.

The oval weld 64 in FIG. 11 is so configured that the two arcuate weld lines at the ends of the oval are not connected with each other, so that the nominal tear line passes from one welded portion to the other in an irregular form. In accord with the illustration in FIG. 11, the oval form of the weld 64 is almost completely closed. If the distances between the weld lines are increased, the nominal tear line may also run along the inside of the oval, and the flat portion of the cover is thus also torn out between the two weld lines of the oval. By this the irregularity of the nominal tear line can be still further intensified.

The cross-shaped weld 65 shown in FIG. 11 represents an open geometric figure. The nominal tear line will extend on both sides of the arms of the cross and enter between these arms. Finally, in the case of the star-shaped weld 66, an open geometric figure is also provided. Here also, the nominal tear line will run along the two sides of the rays of the stars, but will assume a strongly irregular overall shape, as in FIG. 8.

In all examples of FIG. 11, the nominal tear line or pattern 67 is indicated as a dotted line.

Figure 12:
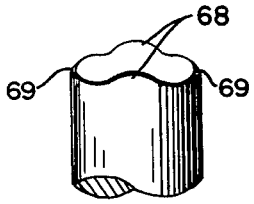
FIG. 12 schematically shows a tool for the preparation of a point-shaped weld in accord with FIG. 11.

In order to influence the nominal tear line, a welding die can be used, having around the periphery of its face, which creates the weld, projecting and depressions or rounded chamfers in more or less irregular configuration. FIG. 12 shows such a circular die, as it can be used for the preparation of an acicular weld 61, as a considerable enlargement. Along the periphery of its face, this welding die has projections 68 and, between them, round chamfers 69. By this configuration of the welding die, a through perforation in the edge of the cover should not be produced but a welded configuration of the welds 61 to 66 with varying strength weld regions. In the area of the projections 68, strong welds are made. In these areas the nominal tear line 67 will run very closely along the edge of the weld 61. In contrast, in the areas of the rounded chamfers 69, only slight welding is produced and only a very gradual transition from the weld to the non-welded portions of the edge of the cover. In this manner, the nominal tear line has a tendency in these latter areas to run at a greater distance from the edge of the weld 61. Analogous conditions are also created in the corresponding welds 62 to 66.

Figure 13:
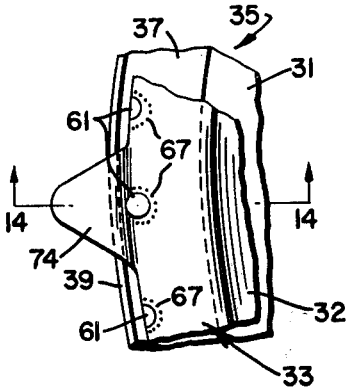
FIG. 13 is a fragmentary plan view illustrating an embodiment of an assurance of originality in accordance with this invention of a section of the container edge and cover edge.
Figure 14:
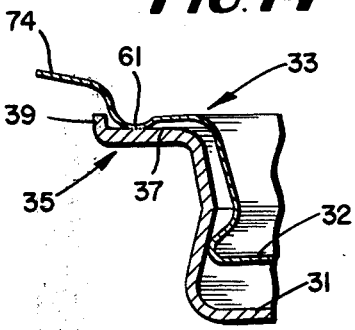
FIG. 14 is a section substantially on line 14—14 of FIG. 13.

In the embodiment of FIGS. 13 and 14, the container 31 itself is provided, on the outer periphery of its edge, with an upper, circumferential collar 39, which surrounds the outer periphery of the cover edge 33. In this manner, manual access to the edge of the cover is made more difficult and the opening of the cover requires at least one gripping tongue 74 which projects beyond collar 39. To assure originality, the edge 33 of the cover is fastened to the container edge 35 in the center of the gripping tongue 74 by means of a point-shaped weld 61 such as one of those in FIG. 11. Around the edge of the cover 33, welds 61 are additionally provided, which can be formed as detachable or non-detachable, weld points, thus points which must be torn out of the edge of the cover. Detachable welds do not tear holes in the cover. The gripping tongue 74 must be seized in order to remove the cover 32 from the container 31, or only to partly lift it. The cover 32 may be pulled off the container by means of the gripping tongue 74. The weld in the center of the gripping tongue 74 tears out along the nominal tear line 67. If they are non-detachable weld points, the other welds 61 also tear out along the indicated nominal tear points. In any case, conspicuous tear marks are left at least on the gripping tongue 74. The function of the snap devices which are arranged, in this case, along the inner peripheral area of the container edge 35 and the edge 33 of the cover is not affected in this manner.

Figure 15:
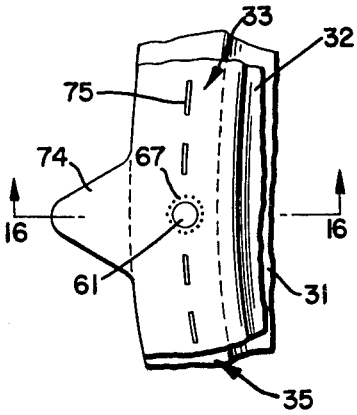
FIG. 15 is a fragmentary plan view showing modification similar to FIG. 13.
Figure 16:
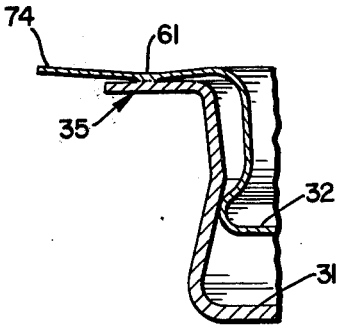
FIG. 16 is a section substantially on lines 16—16 of FIG. 15.

In the embodiment of FIGS. 15 and 16, the container edge 35 and the edge of the cover 33 are so related to each other that they are squared off together on the outer periphery. Only gripping tongues 74 of the edge 33 of cover extend over the edge of container 35. As in the example of FIGS. 13 and 14, the snap devices are arranged along the inner circumference of the container edge and the cover edge. Because the edge 33 of the cover and the edge 35 of the container square off together all around and, in addition, also have a circumferential series of detachable welds 75, a lifting or removal of the cover 32 can only take place when the gripping tongue 74 is seized. However, as in the case of FIGS. 13 and 14, the gripping tongue 74 is sealed by a non-detachable point-shaped weld 61. The removal of the cover 32, or even only a partial removal, can only take place when cover at the weld 61 is first torn open along the nominal tear line 67. Then, the edge of the cover is peeled off all around with the detachment of the detachable welds or seals 75. After the first opening, the cover 32 can again be placed on the container 31 at any time. By the above described operation on the assurance of originality, the snap device is not deleteriously affected.

Figure 17:
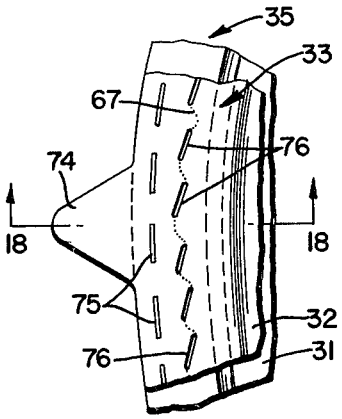
FIG. 17 is a fragmentary plan view showing a further embodiment similar to FIG. 13.
Figure 18:
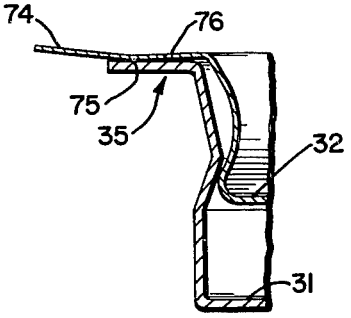
FIG. 18 is a section substantially on line 18—18 of FIG. 17.

In the example of FIGS. 17 and 18, a variation of the invention is shown, where a solid weld between the edge of the cover and the edge of the container is not even necessary for the assurance of originality. In this example also, the edge of cover 33 squares off with the edge of the container 35 on its outer periphery. Somewhat inside the outer peripheral edge, the edge of the cover 33 and the edge of the container 35 are fastened to each other all around by a series of detachable welds or seals 75. To the inside of this series of detachable welds or seals 75, there is a peripheral series of perforations 76, which are arranged at an angle to each other and thus are not in alignment with each other in the peripheral direction. In this manner, these perforations 76 produce an irregular nominal tear line which an irreversible conspicuous tear mark (see dotted lines 67) when the perforated region is torn open. By means of the peripheral detachable welds, or seals 75, the cover 32 can be removed from the container 31, and also only lifted partly if it is seized on a projecting gripping tongue 74. In this manner, the welds or seals 75 located in the vicinity of the gripping tongue are detached, while the other welds still hold all around. The outer edge of the cover must therefore tear at least in the area of the gripping tongue 74, along nominal tear lines 67, which is defined by the series of perforations 76, and this forms the desired, conspicuous tear mark. For the complete opening of the container, the detachable welds or seals 75 are torn off all around. Then, only that portion of the edge 33 of the cover remains on the cover, which lies inside the perforation cuts 76. It is possible by means of this tear mark to grip under this newly-formed irregular periphery of the cover for removal. The snap devices on the cover and container remain unaffected by this first tearing.

Figure 19:
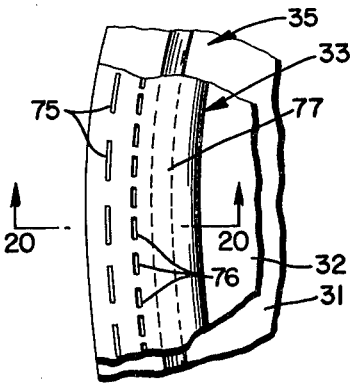
FIG. 19 is a fragmentary plan view showing a further embodiment similar to FIG. 13.
Figure 20:
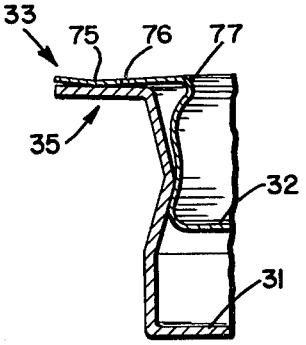
FIG. 20 is a section substantially on line 20—20 of FIG. 19.

In the example of FIGS. 19 and 20, the configuration is almost the same as that in FIGS. 17 and 18. However, instead of the gripping tongue 74, or gripping tongues on the inner circumference of the edge 33 of the cover, a gripping portion 77 is formed on the inner circumference of the edge of the cover. Because, in this example also the edge of the container 35 and the edge 33 of the cover square off together on the outer circumference and are held together by the series of detachable welds or seals 75 which extend all around close to the inside of the outer circumference, it is possible only to lift the cover 32 by seizing the gripping portion 77. Any attempt to lift the cover then has the immediate consequence however that the series of perforations 76 which is arranged within the series of detachable welds or seals tears and forms the desired irreversible, conspicuous tear mark. In the example of FIGS. 19 and 20, non-detachable welds of any configuration could also be provided instead of the detachable welds 75. The portion of the edge of the cover 33 located outside of the series of perforations 76 would then remain on the top side of the container 35 in any case. In any case, the snap device of the cover and container would not be deleteriously affected in this manner.

Figure 21:
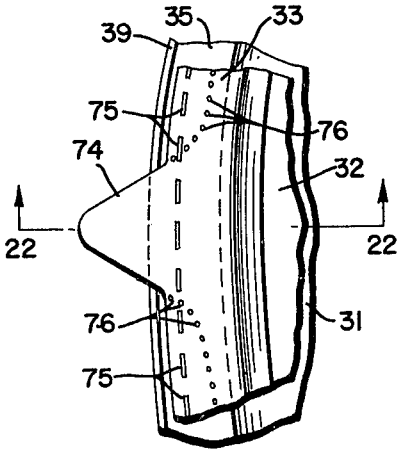
FIG. 21 is a fragmentary plan view showing a further embodiment similar to FIG. 13.
Figure 22:
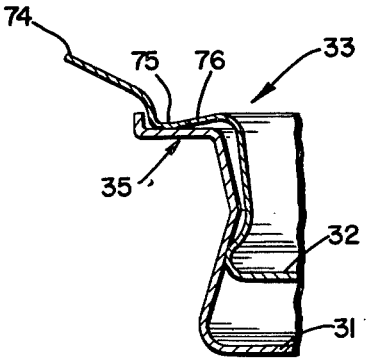
FIG. 22 is a section substantially on line 21—21 of FIG. 20.

In the example of FIGS. 21 and 22, the basic construction is in accord with FIGS. 13 and 14. However, the edge 33 of the cover is fastened to the edge of the container 35 all around by means of a series of detachable welds 75. A series of perforations 76 is arranged within this series of detachable welds 75. The gripping tongue 74 projects outwardly beyond the collar 39 on the edge of container 35. The series of perforations 76 crosses the series of detachable welds on both sides of this gripping tongue so that the perforations end on the outer circumference of the cover edge on both sides of the gripping tongue 74. Because, in this embodiment, the cover 32 is still more strongly protected against removal from the container 31 than in the example of FIGS. 13 and 14, it is absolutely necessary, for the removal of the cover, to seize tongue 74. In this case, the welds 75, arranged in the area of the gripping tongue itself, are detached and the edge of the cover 33 is torn open along the series of perforations 76, with the formation of the desired irreversible, conspicuous tear mark. Because, in this example also, the snap device is arranged along the inner circumference of the edge 33 of the cover and the edge of the container 35, it remains unaffected by the first tearing open of the cover. Non-detachable welds, for example those in accord with FIG. 9, or those in accordance with FIG. 11, can also be provided instead of the detachable welds 75.

A further embodiment of the invention is described in the following, with reference to FIGS. 1–4.

In the case of some materials and some structures where it is very difficult to provide the nominal tear line itself with an irregular configuration, and the cover material has the tendency to tear very exactly along the edge of the weld 41 or along the perforation 42, and thus results in only a slight tear marking, the container, in its covering and closure, as well as in the application of the fastening points 40, can be placed in a holding device which does not completely correspond to the cross-sectional shape of the container 31. In this manner, the container is somewhat elastically deformed during closure and until application of the cover mounting fastening points.

After the removal of the container from the receptor, this elastic deformation will then remain as a deformation of the container and the cover until one or another of the fastening points 40 is detached. A relaxation then takes place, with the result that the flat, annular edge area 38 of the edge of the cover and the flat area 37 of the edge of the container 35 shift sidewise with respect to each other. In this manner, the residual portions of the cover which are torn out and remain on the edge 35 can no longer enter into the holes torn in the flat, annular edge portion 38 of the edge of the cover. The effectiveness of the snap device 34 is not deleteriously affected in this manner because this snap device 34, as shown in FIG. 3, has sufficient vertical pliability to also still assure a secure hold in the cover 32 in the opening of the container 31 even when the flat, annular edge area 38 of the edge of the cover is kept at some distance above the flat area portions 37 of the edge of the container 35. This mutual stress and deformation of container and cover can also be additionally used to advantage in the case of all other above-described embodiments so that the remainder on the container edge 35 or 55 shifts with respect to the hole torn out of the edge of the cover, with stress relaxation on the container and the cover. In each case, the conspicuousness can be further increased by a conspicuous color difference of the edge of the container and the edge of the cover because the edge of the container, with its conspicuous color difference, is exposed through the hole torn in the edge of the cover. In the case of detachable bonds 75, it becomes conspicuous in the case of such a color difference, when the weld or seal 75 has been loosened.

Figure 23:
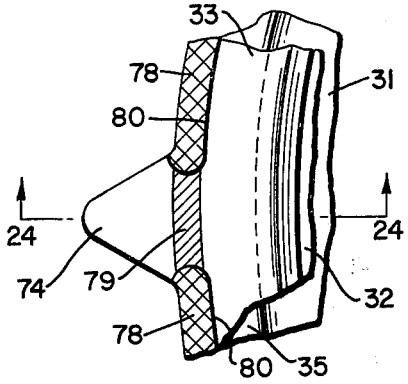
FIG. 23 is a fragmentary plan view showing a modification of the embodiment shown in FIG. 21.
Figure 24:
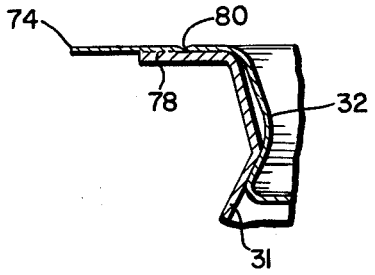
FIG. 24 is a section on line 24—24 in FIG. 23.

In the example of FIGS. 23 and 24, there is additionally a case of providing a container which has been originally closed completely air-tight. After opening of the original closure, the seal which is obtained with the snap closure can then suffice during the consumption of the content of the container. Starting with a container constructed in accord with FIGS. 17 and 18, in the embodiment of FIGS. 23 and 24, for example, the edge of the cover 33 is welded all around non-detachably and air-tight, along the outer circumferential area 78, to the edge of the container 35, with the exception of the area 79 at the gripping tongue 74. In this place, a detachable but air-tight weld 79 which fits closely and without gap between the weld 78 sections is applied. A groove 80, preforming the nominal tear line, and to be applied during the welding, extends from both sides of the gripping tongue 74 within the rigid weld 78 all around the edge of the cover. This groove 80 laterally crosses the weld which runs all around at the transition between the solid weld 78 and the detachable weld 79. If the air-tight closure at 79 is violated by an even only partial lifting of the cover 32 from the container 31, the edge of the cover 33 tears along the groove 80 and can no longer return into its original position because a permanent material deformation has occurred between the two end areas of the notch 80 during the tearing of the detachable weld 79, with the result that the area of edge 33 of the cover which is adjacent to the gripping tongue 74 will no longer fit between the end areas of the groove 80.

Figure 25:
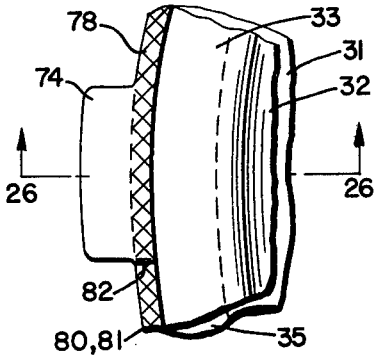
FIG. 25 is a fragmentary plan view showing an embodiment similar to FIGS. 17 and 18.
Figure 26:
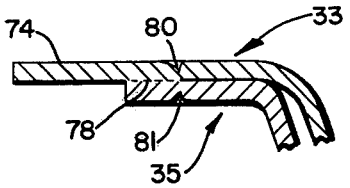
FIG. 26 is a section substantially on line 26—26 of FIG. 25.

In the embodiment of FIGS. 25 and 26, the edge 33 of the cover is again closed all around and welded air-tight, around the outer circumferential area 78, with the edge of the container 35. In this case, a circumferential groove 80 is applied to the edge of the cover 33 and also a circumferential groove 81 on the underside of the edge 35 of the container, inwardly of this non-detachable air-tight weld 78. On one side of the gripping tongue 74, a pair of grooves 82, extending radially, are formed in both the edge 33 of the cover and the edge 35 of the container below it. If, in this embodiment, it is desired to only partially open the cover 32, the solidly welded circumferential portion both of the edge of the cover and the edge 35 of the container must be torn off at the preformed nominal tear line 80, 81. Because the edge 35 of the container is generally considerably heavier than the edge 33 of the cover, this difference in thickness suffices to cause a deformation while tearing open, preventing a re-application of a portion of the outer edge which is torn off, thus leaving a conspicuous tear mark. This can be further reinforced in that the two grooves 80 and 81 may be somewhat radially offset with respect to each other, as illustrated in FIG. 26 in dotted lines.

Figure 28:
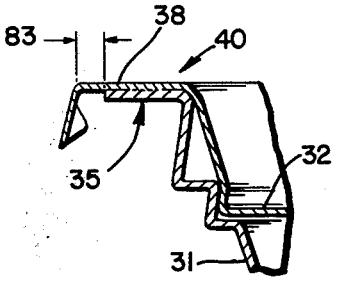
FIG. 28 is an enlarged section substantially along line 28—28 of FIG. 27.
Figure 27:
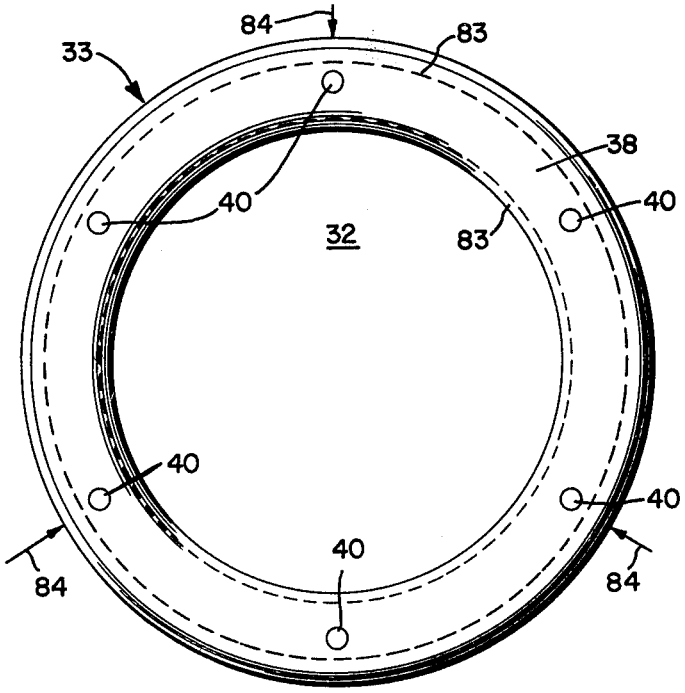
FIG. 27 is a plan view showing a further embodiment of the invention.
Figure 29:
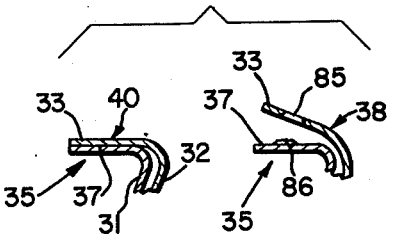
FIG. 29 is a vertical section showing a modification of the embodiment of FIGS. 27 and 28.

FIGS. 27–29 disclose embodiments in which a reciprocal elastic stress of the edge of the container and the edge of the cover is used to offset the nominal tear line in such a manner that the portion of the material torn out of the edge of the cover upon cover displacement or removal can no longer be inserted into the corresponding hole of the edge of the cover. In FIGS. 27 and 28, such a reciprocal elastic stress can be caused in that the container, for the purpose of covering and welding of the cover at the fastening points 40, is inserted into a fixture which exerts radial forces on the container in various areas, for example in three areas which are subjected to a displacement of about 120° on the wall of the container, as indicated by the arrows 84. In this manner, the wall of the container is displaced inwardly in a radial direction in these areas.

In contrast, as shown in FIG. 28, the cover has radial clearance 83 in its flat edge area 38, with respect to the container edge 35 which is configured with the flat area 37. In those areas in which the radial forces 84 act on the circumferential wall of the container, this radial clearance 83 will lie upon the outer circumferential area of the flat edge portion 38, while, in the intermediate area between the points of action of the forces 84, the clearance 83 displaces to the inner circumferential area of the flat edge portion 38. These relative positions of the flat edge portion 38 and the flat surface 37 establish by the stressing forces 84 is maintained by the application of fastening points 40. When the container, which is covered and provided with the fastening points 40, is removed from the fixture, equilibrium will naturally establish itself, where both the container 31 and the cover 32 are under stress. If one of the fastening points 40 is then loosened, a mutual shift of the flat area 37 and the flat edge portion 38 occurs there, with at least partial relaxation of the stress. In this manner, the spot of material torn out of the flat edge portion 38 of the cover 32 at the fastening point 40 can no longer return into the hole which thus develops, but is shifted sidewise with respect to this hole.

When, within the scope of the above description, "flat area 37" of the edge of the container 35, respectively 55, and "flat, annular edge area 38" of the cover 32, respectively 52 is mentioned, this means an essentially flat configuration, but not necessarily an absolutely plane configuration. Such a flat configuration can have, for example, a slightly conical or a slightly curved profile. Use is made of this fact in the example of the embodiment in accordance with FIG. 29. There, for example, the flat annular edge area 38 of the cover 32 has a slightly conical configuration which is raised towards the outside, while the flat area 37 of the edge of the container 35 initially has a conical or curved configuration which tends slightly towards the bottom and to the outside. In this manner, the flat, annular edge area 38 and the flat area 37 tend to separate towards the outside. By the application of the fastening points as at 40, the flat, annular edge area 38 and the flat area 37 are held rigidly together there, so that, along its circumference, the edge of the cover assumes a somewhat wavy configuration. By tearing open a fastening point 40, these two parts return into their original position which is shown on the right in FIG. 29. The hole 85 which is torn in the flat, annular edge area 38 of the cover 32 is thus kept at a distance above the remainder 86 of the material torn out of the flat, annular edge area 38. A conspicuous tear mark results from this distance and the fact that the waviness ceases at a torn fastening point.

All characteristics of the subject of the application, which are shown in the disclosure, the claims, and the drawing, can, alone or in any possible conceivable combination, be of essential significance for the invention.

We claim:

1. A container assembly having a safeguard against undetectable unauthorized or partial opening after a cover is initially applied comprising a container adapted to receive material to be packaged and having an open end, a cover for said open end, said container and said cover having around their outer peripheries generally flat annular edge regions in coextensive adjacent relation, cooperating formations on the cover and container providing a reusable snap fit connection between the cover and container permitting the cover to be reapplied with a snap fit after each removal from the container, and said safeguard being independent of said formations and comprising fastening means fixedly connecting said edge regions closely together after a container has initially been filled and the cover snapped thereupon over the opening, said fastening means being so constructed and arranged that upon rupture of fastening means for separation of said regions for partially or fully opening said container assembly a tear line pattern is formed at least in the cover edge region adjacent said ruptured fastening means, said tear line pattern being such that upon reclosure of the cover the cover and container edge regions cannot be undetectably reassembled in the initial cover closed condition.

2. Container in accord with claim 1, characterized in that the fastening means comprises at least one non-detachable weld between the cover and container edge regions and the tear line pattern is formed during destruction of this weld.

3. Container in accord with claim 2, characterized by said weld of small area with a desired geometric configuration, as in the form of a point or line.

4. Container in accord with claim 2, characterized by said weld being in a completely closed, almost completely closed or open geometric configuration, as in the form of a triangle, ring, oval, star, or cross.

5. Container in accord with claim 2, characterized by said tear line pattern being defined by one or more perforations in the cover adjacent said weld.

6. Container in accord with claim 5, characterized in that perforations are arranged in a pattern surrounding said weld.

7. Container in accord with one claim 2, characterized in that the tear line pattern is preformed in the cover by reductions in thickness of the cover material around the weld (41, 48).

8. Container in accord with claim 2, characterized in that the tear line pattern is predetermined by the edge configuration of the weld.

9. Container in accord with claim 2, characterized in that a plurality of relatively small weld points are circumferentially distributed around said edge regions, each having an associated tear line pattern.

10. Container in accord with claim 2, characterized in that at least one non-detachable weld is provided between said edge regions in an area to be ruptured by actuation said gripping means, while the remaining circumferential areas of said edge regions are connected by detachable welds.

11. Container in accord with claim 10, characterized in that the cover edge is surrounded by an upwardly projecting collar on the edge of the container.

12. Container in accord with claim 1, characterized in that the outer peripheries of said edge regions are sealed all around except for a detachably connected area where the cover is provided with a gripping tongue.

13. Container in accord with claim 1, characterized in that said edge regions are fastened together by annular detachable weld means and perforations extend adjacent said weld means to define the tear pattern.

14. Container in accord with claim 13, characterized in that the cover is provided, on its outer circumference, with at least one tongue-shaped gripping portion.

15. Container in accord with claim 14, characterized in that the perforation line crosses the annular detachable weld on both sides of said gripping portion and ends in the outside periphery of the cover.

16. Container in accord with claim 13, characterized in that the cover is formed on its inner circumference adjacent its edge region with at least one gripping portion.

17. Container in accord with claim 13, characterized in that the detachable weld means is formed by an annular series of point-shaped or line-shaped welded areas.

18. Container in accord with claim 13, characterized in that the perforations are formed as a series of angularly related enlongated cuts.

19. Container in accord with claim 1, characterized in that said edge regions have conspicuous color differences.

20. Container in accord with claim 1, characterized in that at least the edge region of the cover consists of thermoplastic synthetic material, and the edge region of the container has considerably greater tear resistance than the cover edge region.

21. Container in accord with claim 1, characterized in that the container is initially held by said fastening means deformed from its normal cross-sectional shape so that once the cover is removed the container resumes its normal shape.

22. Container in accord with claim 21, characterized in that the container is held by non-detachable fastening points at said edge regions on essentially axially stressed and elastically deformed condition.

23. Container in accord with claim 1, characterized in that the edge region of the container is formed to normally extend angularly relative to the flat end region of the cover, and said fastening means comprises non-detachable welds holding said edge regions in flat substantial contact in the initial assembly.

24. Container in accord with claim 10, characterized in that a snap formation on the cover fits into an undercut formed in the inside circumference of the container side wall.

* * * * *

UNITED STATES PATENT OFFICE

CERTIFICATE OF CORRECTION

Patent No. 4,006,839 Dated February 8, 1977

Inventor(s) Alfons W. Thiel, Hans Hell

Figure 6:
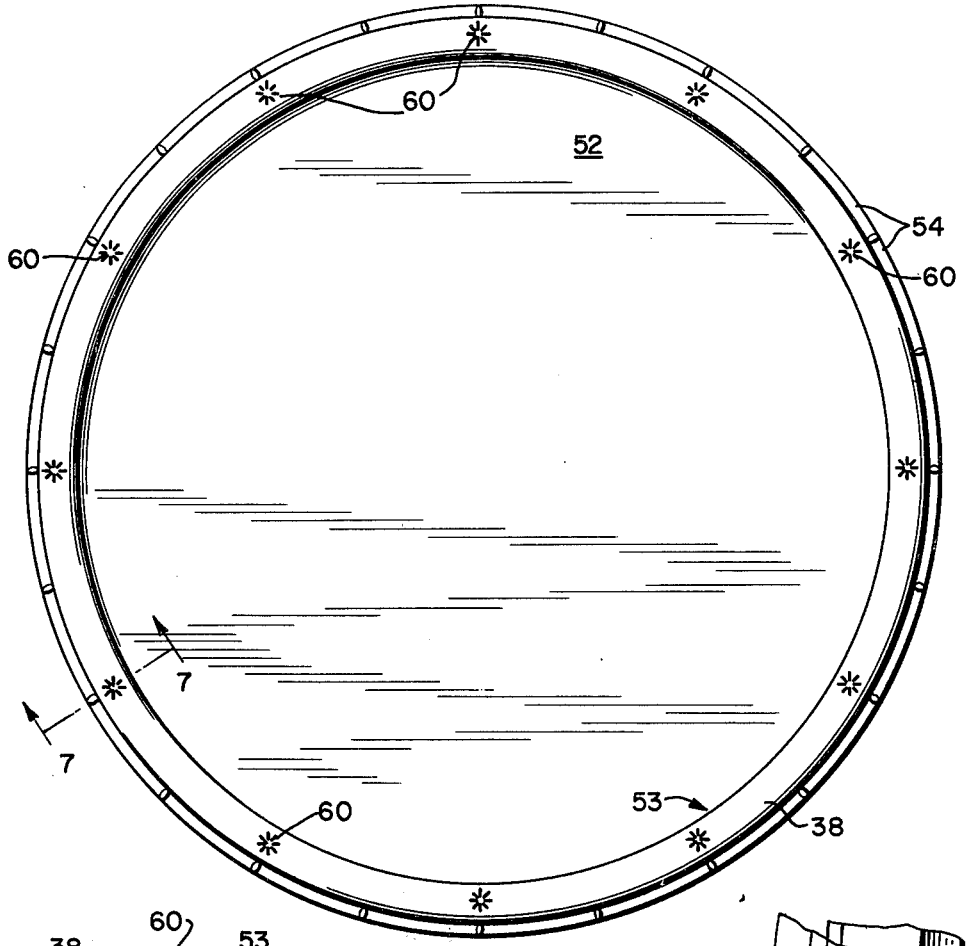
FIG. 6 is a plan view of the menu plate of FIG. 5.
Figure 7:
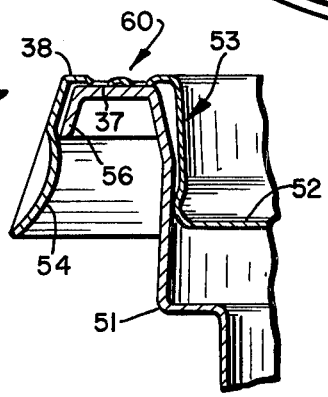
FIG. 7 is an enlarged view in section substantially along line 7—7 of FIG. 6.

It is certified that error appears in the above-identified patent and that said Letters Patent are hereby corrected as shown below:

Column 4, line 11
Indent in paragraph form Fig. 6

Column 4, line 44
Indent in paragraph form Fig. 20

Column 12, line 57
After weld insert --being--

Column 14, line 27
Change "on" to --in--

Signed and Sealed this

Fifth Day of April 1977

[SEAL]

*Attest:*

RUTH C. MASON
*Attesting Officer*

C. MARSHALL DANN
*Commissioner of Patents and Trademarks*